US011324367B2

(12) United States Patent
Sørrig Dodt

(10) Patent No.: US 11,324,367 B2
(45) **Date of Patent: *May 10, 2022**

(54) SUCTION NOZZLE FOR REMOVING HAIR FROM TEXTILE SURFACES

(71) Applicant: Haarbold ApS, Ry (DK)

(72) Inventor: Allan Sørrig Dodt, Ry (DK)

(73) Assignee: HAARBOLD APS, Ry (DK)

( * ) Notice: Subject to any disclaimer, the term of this patent is extended or adjusted under 35 U.S.C. 154(b) by 401 days.

This patent is subject to a terminal disclaimer.

(21) Appl. No.: 16/410,838

(22) Filed: May 13, 2019

(65) Prior Publication Data

US 2019/0261823 A1 Aug. 29, 2019

Related U.S. Application Data

(63) Continuation-in-part of application No. 15/307,647, filed as application No. PCT/DK2015/050112 on Apr. 30, 2015, now Pat. No. 10,327,611.

(30) Foreign Application Priority Data

May 1, 2014 (DK) ..... PA201470267

(51) Int. Cl.
*A47L 9/06* (2006.01)

(52) U.S. Cl.
CPC ..... *A47L 9/0613* (2013.01)

(58) Field of Classification Search
CPC ..... A47L 9/0613
See application file for complete search history.

(56) References Cited

U.S. PATENT DOCUMENTS

| | | | |
|---|---|---|---|
| 2,807,825 | A | 10/1957 | Gardner |
| 3,955,238 | A | 5/1976 | Remijas |
| 2006/0248680 | A1 | 11/2006 | Heidenga et al. |
| 2011/0308035 | A1 | 12/2011 | Casper |
| 2013/0145576 | A1 | 6/2013 | Hollis |

FOREIGN PATENT DOCUMENTS

| | | | |
|---|---|---|---|
| DE | 2 309 137 | A1 | 8/1974 |
| DE | 198 29 044 | A1 | 1/2000 |
| EP | 0 118 765 | A1 | 9/1984 |
| FR | 1 331 501 | | 5/1963 |
| GB | 315177 | | 7/1929 |
| GB | 2 425 715 | A | 11/2006 |
| WO | WO 2009/133031 | A1 | 11/2009 |

*Primary Examiner* — David Redding
(74) *Attorney, Agent, or Firm* — Crowell & Moring LLP; John C. Freeman

(57) ABSTRACT

The present invention relates to a suction nozzle add-on for cleaning apparatuses. More specifically, the present invention relates to a suction nozzle add-on for removing hair from a textile surface.

17 Claims, 6 Drawing Sheets

SUCTION NOZZLE FOR REMOVING HAIR FROM TEXTILE SURFACES

RELATED APPLICATIONS

This application is a continuation-in-part of U.S. application Ser. No. 15/307,647, that has a § 371(c) date of Oct. 28, 2016, which claims the benefit under 35 U.S.C. § 371 of International Application No. PCT/DK2015/050112, filed Apr. 30, 2015, which claims the benefit of Danish Patent Application No. PA 2014 70267, filed May 1, 2014 which are incorporated by reference herein in their entirety.

TECHNICAL FIELD OF THE INVENTION

The present invention relates to a suction nozzle for cleaning apparatuses. More specifically, the present invention relates to a suction nozzle for removing hair from a textile surface.

BACKGROUND OF THE INVENTION

The hairs of domestic animals and particularly dogs and cats have long posed a problem for their owners who have rugs and carpets in their car, their home and in the rooms in which the animals are allowed. Vacuum cleaners are commonly used, but adherence between the animal hairs and the carpeting is such that the vacuum cleaner has to be taken over the same area, time and time again, to effect any sort of thorough removal of the animal hairs. A suction nozzle attached to the vacuum cleaner is frequently useful, but the filaments/protrusions of the suction nozzle have to be cleaned out regularly, and this is a messy, difficult, and time consuming chore.

SUMMARY OF THE INVENTION

Hence, one object of the present invention is to provide a cleaning tool that both quickly and thoroughly removes animal hairs from textile materials, such as carpet materials.

One aspect relates to a suction nozzle for cleaning apparatuses, such as vacuum cleaners, for removing hair from a textile surface, comprising:

- a housing, the housing comprising a pipe socket for connecting the pipe of a cleaning apparatus with the suction nozzle;
- a base section having an outer edge, a first face attached to the housing, and a second face comprising a plurality of projections and one or more inlets for airflow;

wherein the plurality of projections are resilient bendable, which plurality of projections are so mounted on the second face that when they are brought into contact with the textile surface to be cleaned during a sweeping motion, they are bent away from their initial position, away from the direction of sweep and, when said projections lose contact with said textile surface, said projections rebound to their initial position;

wherein the plurality of projections are aligned in a plurality of parallel rows, and wherein the plurality of parallel rows are mounted on the second face of the base section so as to define a passage running from the outer edge towards the one or more inlets for airflow, said passage having a distal end facing the outer edge and a proximal end facing the one or more inlets; wherein at least the outer layer or coating of the plurality of projections are made from elastomer for accumulating said hair on the surface; wherein the width of the distal end of said passage is at least 1 cm, and wherein the width of the proximal end of said passage is narrower than the width of the distal end, for guiding the accumulated hair at the surface towards the one or more inlets.

Disclosed herein is a suction nozzle for cleaning apparatuses, such as vacuum cleaners, for removing hair from a textile surface. The suction nozzle comprises a housing and a base section.

The term "textile" refers to any material made through weaving, knitting, spreading, crocheting, or bonding that may be used in production of further goods.

The housing comprises a pipe socket for connecting the pipe of a cleaning apparatus with the suction nozzle.

The base section has an outer edge, a first face attached to the housing, and a second face comprising a plurality of projections and one or more inlets for airflow. The plurality of projections are resilient bendable, i.e. when the projections are bent during a sweeping motion over a textile surface, they rebound (or return) towards their initial position when they lose contact with said textile surface.

In one or more embodiments, the plurality of projections are made of a material having a Shore A-scale hardness measured according to ASTM D2240-97 within the range of 40-70, such as within the range of 45-70, e.g. within the range of 50-70. Preferably, the projections are made of a material having a Shore A-scale hardness measured according to ASTM D2240-97 within the range of 60-70, e.g. 65-70. This range of hardness secures that the projections are not too soft to withstand continuous and prolonged use, and that they are still resilient bendable. If the hardness is above 70, the projections may risk damaging the textile surface, and lack the resilient bendability.

In the present context, the term "projections" refers to bristles, filaments or strips or teeth of a flexible material.

The plurality of projections are so mounted on the second face that when they are brought into contact with the textile surface to be cleaned during a sweeping motion, they are bent away from their initial position, away from the direction of sweep. The inventor has found that when using projections where at least the outer layer or coating is made from elastomer, the hairs on a textile surface are rolled together to form elongate hair rolls. Hence, at least the outer layer or coating of the plurality of projections is made from elastomer for accumulating hair on the surface.

In one or more embodiments, the projections are made from elastomer.

The term "elastomer" is intended to mean an amorphous high polymer (or mixture thereof) above its/their glass transition temperature. Elastomers can be stretched and retracted rapidly; exhibit high strength and modulus when stretched; and recover fully when the stress is removed. The term "elastomer" includes covalently-linked elastomers, in which the polymer(s) is/are permanently cross-linked to restrain gross mobility, and thermoplastic elastomers, in which the polymer(s) is/are reversibly cross-linked to restrain gross mobility. Thermoplastic elastomers (TPE) are a class of copolymers or a physical mix of polymers (usually a plastic and a rubber) which consist of materials with both thermoplastic and elastomeric properties.

In one or more embodiments, the elastomer is selected from the group consisting of polyisobutylene (PIB), butyl rubber (IIR), neoprene (CR), nitrile rubber (NBR), ethylene propylene diene monomer (EPDM), ethylene propylene monomer (EPM), styrene-butadiene-styrene (SBS), polyether block amide (PEBA), thermoplastic polyurethanes (TPU), thermoplastics olefins (TPO), silicone elastomers, vinyl methyl silicone (VMQ), phenyl vinyl methyl silicone (PVMQ), fluoro vinyl methyl silicone (FVMQ), methyl silicone (MQ), fluoroelastomers (FKM), perfluoroelastomers (FFKM), polyacrylic elastomers (ACM), acrylic ethylene (AEM), chlorosulfonated polyethylene (CSM), epichlorohydrin elastomers (CO and ECO), and mixtures thereof.

In order to secure that the accumulated hair can be effectively removed from the textile surface, the plurality of projections are aligned in a plurality of parallel rows, being mounted on the second face of the base section so as to define a passage running from the outer edge towards the one or more inlets for airflow. The passage has a distal end facing the outer edge and a proximal end facing the one or more inlets.

In one or more embodiments, the plurality of parallel rows are mounted in one or more units, and wherein a first and a second parallel row in a first unit are offset such that an individual projection in the first row cover the space between two individual (neighbouring) projections in the second row when they are brought into contact with the textile surface to be cleaned during a sweeping motion, and bent away from their initial position, away from the direction of sweep. Such construction has proven to be especially effective at releasing the hairs from the textile surface.

In one or more embodiments, the plurality of projections are so mounted on the second face that the width of an individual projection is equal to or larger than the space between two individual (neighbouring) projections in the same row.

In one or more embodiments, the plurality of projections are so mounted on the second face that the width of an individual projection is equal to or larger than the space between two individual neighbouring projections in the same row.

It is preferable that the projections are of a minimum length and width for them to bend and interact with (or touch) projections of a neighbouring row.

In one or more embodiments, the width of the plurality of projections is within the range of 2-30 mm, such as within the range of 3-25 mm, e.g. 4-20 mm, such as within the range of 5-20 mm, e.g. 6-15 mm, such as within the range of 7-15 mm, e.g. 8-15 mm, such as within the range of 9-15 mm, e.g. 10-15 mm. Preferably, the width of the plurality of projections is within the range of 2-10 mm, e.g. 4-8 mm.

In one or more embodiments, the length of the plurality of projections is within the range of 5-50 mm, such as within the range of 6-45 mm, e.g. 7-40 mm, such as within the range of 8-35 mm, e.g. 9-30 mm, such as within the range of 10-25 mm, e.g. 10-20 mm. Preferably, the width of the plurality of projections is within the range of 8-25 mm, e.g. 12-15 mm.

In one or more embodiments, the width of the plurality of projections is within the range of 2-30 mm, and the length of the plurality of projections is within the range of 5-50 mm.

In a preferred embodiment, the width of the plurality of projections is 4 mm, the length of the plurality of projections is 13 mm, and the distance between individual projections in the same row is 3 mm.

When the user is rubbing or sliding the suction nozzle across the textile surface, the accumulated hair is then guided/forced through the passage towards the one or more inlets to be suctioned into the vacuum cleaner. The inventor has found that it is crucial that the width of the distal end of said passage is at least 1 cm to accommodate the formed elongate hair rolls; and the width of the proximal end of said passage should be narrower than the width of the distal end (so as to form a funnel type shape), for guiding the accumulated hair at the surface towards the one or more inlets. Else, the elongate hair rolls will get stuck in the passage. The upper limit of the width of the distal end of said passage is only limited by the dimensions, (e.g. the width) of the suction nozzle. In one embodiment, the width of the distal end of the passage is at least 1 cm, e.g. at least 2 cm, such as at least 3 cm, e.g. at least 4 cm, such as at least 5 cm, e.g. at least 6 cm, such as at least 7 cm, e.g. at least 8 cm, such as at least 9 cm, e.g. at least 10 cm, such as at least 11 cm, e.g. at least 12 cm, such as at least 13 cm, e.g. at least 14 cm, such as at least 15 cm, e.g. at least 20 cm.

In one or more embodiments, the plurality of parallel rows are mounted in a plurality of units, wherein the plurality of units are mounted on the second face of the base section so as to define a passage running from the outer edge towards the one or more inlets for airflow, said passage having a distal end facing the outer edge and a proximal end facing the one or more inlets; wherein the width of the distal end of said passage is at least 1 cm, and wherein the width of the proximal end of said passage is narrower than the width of the distal end, for guiding the accumulated hair at the surface towards the one or more inlets. In one embodiment, the width of the distal end of the passage is at least 1 cm, e.g. at least 2 cm, such as at least 3 cm, e.g. at least 4 cm, such as at least 5 cm, e.g. at least 6 cm, such as at least 7 cm, e.g. at least 8 cm, such as at least 9 cm, e.g. at least 10 cm, such as at least 11 cm, e.g. at least 12 cm, such as at least 13 cm, e.g. at least 14 cm, such as at least 15 cm, e.g. at least 20 cm.

In one or more embodiments, the passage formed by the plurality of rows and/or the plurality of units runs essentially parallel to the intended direction of sweep. In one or more embodiments, at least the central portion of the passage formed by the plurality of rows and/or the plurality of units runs essentially parallel to the intended direction of sweep.

In one or more embodiments, the width of the plurality of projections have different moments of resistance depending on the bending direction, so that when they are brought into contact with the textile surface to be cleaned, they are bent essentially in the lowest moment of resistance.

In yet another embodiment, the projections have a high co-efficient of friction with the textile surface.

The process of electron transfer as a result of two objects coming into contact with each other and then separating is known as 'triboelectric charging'. The process of triboelectric charging results in one object gaining electrons on its surface, and therefore becoming negatively charged, and another object losing electrons from its surface, and therefore becoming positively charged. Which material becomes negative and which becomes positive depend on the relative tendencies of the materials involved to gain or lose electrons. Some materials have a greater tendency to gain electrons than most others, in the same way that there are others which tend to lose electrons easier than others. Hair has a tendency to become triboelectrically positively chargeable when in contact with a textile surface.

In one embodiment, at least the outer layer, or coating, of the plurality of projections is made from elastomer which is triboelectrically negatively chargeable for releasing the hair from said textile surface.

A static discharge in the presence of air or oxygen can create ozone. Many elastomers are sensitive to ozone cracking. Exposure to ozone may therefore create deep penetrative cracks in the projections unless preventive action is taken.

In one embodiment, the projections are made from an elastomer composition further comprising anti-ozonants.

In another embodiment, the projections are made from ozone-resistant elastomer. To avoid that the hair does not "slip" through between the rows of projections, but are guided towards the passage, it may be desirable to offset the rows such that a first row of the aligned projections is not aligned with a second row of the aligned projections.

In one embodiment, the plurality of parallel rows are offset such that a first row of the aligned projections is not aligned with a second row of the aligned projections. To improve the loosening of hairs from the textile surface, the free end face of an individual projection may be shaped with corners or edges, as for example if the free end face of the projections are v-shaped, star-shaped, squared or triangular; and wherein the individual projection has a planar end face.

In one embodiment, at least the free end face of an individual projection has a non-circular shape; and wherein the individual projection has a planar end face. In one embodiment, at least the free end face of an individual projection has a shape selected from the group consisting of squared, v-shaped, star-shaped, and triangular; and wherein the individual projection has a planar end face.

In one embodiment, the individual projection has a non-circular cross-section taken near its tip.

In one embodiment, the individual projection has a squared, v-shaped, star-shaped, or triangular cross-section taken near its tip.

In one embodiment, the projections have at least a semi-rigid core, coated by elastomer, to provide sufficient rigidity to the projections; wherein the semi-rigid core being made of a material having a Shore A-scale hardness measured according to ASTM D2240-97 within the range of 50-70, such as a Shore A-scale hardness measured according to ASTM D2240-97 within the range of 60-70, e.g. 65-70.

Also disclosed herein is a suction nozzle add-on for cleaning apparatuses, for removing hair from a textile surface, the suction nozzle add-on comprising a pipe socket for connecting the suction nozzle add-on to a pipe of a cleaning apparatus or a suction nozzle already attached to the cleaning apparatus; wherein the pipe socket comprises a front face having an outer edge, the front face comprising a plurality of projections and an inlet for airflow; wherein the plurality of projections are resilient bendable, the plurality of projections are mounted on the front face so that when the plurality of projections are brought into contact with the textile surface to be cleaned during a sweeping motion, the plurality of projections are bent away from an initial position, away from the direction of sweep and, when the plurality of projections lose contact with the textile surface, the plurality of projections rebound to the initial position; wherein the plurality of projections are aligned in a plurality of parallel rows, and wherein the plurality of parallel rows are mounted on the front face to define a passage running from the outer edge towards the inlet for airflow, the passage having a distal end facing the outer edge and a proximal end facing the inlet; wherein at least an outer layer or coating of the plurality of projections are made from an elastomer for accumulating the hair on the surface; and wherein a width of the proximal end of said passage is narrower than the width of the distal end, for guiding the accumulated hair at the surface towards the inlet.

In one or more embodiments, the front face has a shape resembling that of the pipe of a cleaning apparatus or the suction nozzle already attached to the cleaning apparatus. In one or more embodiments, the shape of the front face is oval.

In one or more embodiments, the pipe socket and the plurality of projections are made from the same material. Thus, in an example, the pipe socket is made of a material having a Shore A-scale hardness measured according to ASTM D2240-97 within the range of 40-70, such as 50-70, such as 60-70, e.g. 65-70. Choosing the same material for the entire suction nozzle add-on allows the nozzle add-on to be made in the same process, e.g. by injection moulding.

In one or more embodiments, the pipe socket is resilient bendable when being connected to a pipe of a cleaning apparatus or a suction nozzle already attached to the cleaning apparatus, and wherein the pipe socket rebounds to its initial shape when being removed from the pipe of a cleaning apparatus or the suction nozzle already attached to the cleaning apparatus.

It should be noted that embodiments and features described in the context of one of the aspects of the present invention also apply to the other aspects of the invention.

DETAILED DESCRIPTION OF THE INVENTION

Figure 1:
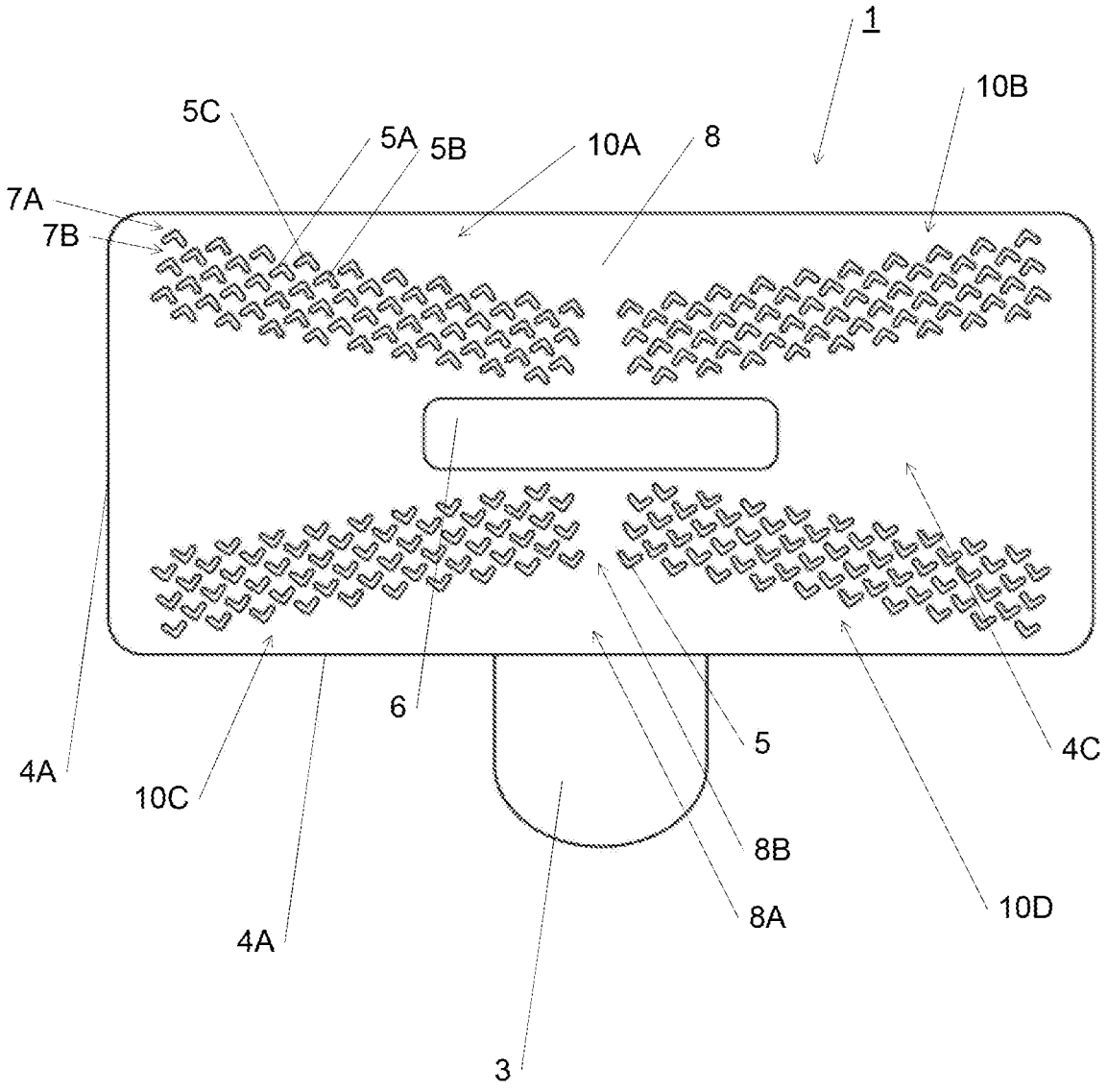
FIG. 1 shows a first suction nozzle of the present invention, viewed from the second face.

Vacuum cleaners typically have a suction nozzle in communication with a source of suction. The suction nozzle therefore forms an inlet for airflow, where dirt and other debris together with the air are suctioned into the vacuum cleaner. Vacuum cleaners may be provided with means for cleaning along edges or baseboards of rooms and near kick plates of cabinetry and appliances. Such means include providing a vacuum hose between the suction nozzle and the suction source that can be selectively removed from communication with the suction nozzle. When the vacuum hose is removed from the suction nozzle, suction is generated at the inlet of the vacuum hose.

It is to be understood that the specific devices illustrated in the attached drawings, and described in the following specification are simply exemplary embodiments of the inventive concepts defined in the appended claims. Hence, specific dimensions and other physical characteristics relating to the embodiments disclosed herein are not to be considered as limiting, unless the claims expressly state otherwise.

One object of the present invention is to provide a cleaning tool that both quickly and thoroughly removes animal hairs from textile materials, such as carpet materials.

One aspect of the present invention relates to a suction nozzle 1 for cleaning apparatuses, such as vacuum cleaners, for removing hair from a textile surface, comprising:

- a housing 2, the housing comprising a pipe socket 3 for connecting the pipe of a cleaning apparatus with the suction nozzle;

a base section 4 having an outer edge 4A, a first face 4B attached to the housing 2, and a second face 4C comprising a plurality of projections 5 and one or more inlets 6 for airflow;

wherein the plurality of projections 5 are resilient bendable, which plurality of projections 5 are so mounted on the second face 4C that when they are brought into contact with the textile surface to be cleaned during a sweeping motion, they are bent away from their initial position, away from the direction of sweep and, when said projections 5 lose contact with said textile surface, said projections 5 return to their initial position;

wherein the plurality of projections 5 are aligned in a plurality of parallel rows 7, and wherein the plurality of parallel rows 7 are mounted on the second face 4C of the base section 4 so as to define a passage 8 running from the outer edge 4A towards the one or more inlets 6 for airflow, said passage 8 having a distal end 8A facing the outer edge 4A and a proximal end 8B facing the one or more inlets 6;

wherein at least the outer layer or coating of the plurality of projections 5 are made from elastomer for accumulating said hair on the surface; wherein the width of the distal end 8A of said passage 8 is at least 1 cm, and wherein the width of the proximal end 8B of said passage 8 is narrower than the width of the distal end, for guiding the accumulated hair at the surface towards the one or more inlets 6.

Referring to FIG. 1, a suction nozzle viewed from the second face is shown having only one inlet 6 for airflow. This embodiment allows the hair rolls to be directed through one passage at each side of the outer edge 4A towards the one centrally placed inlet 6. The planar end faces of the projections are v-shaped.

The plurality of parallel rows 7 are mounted in four units 10A-D, and a first and a second parallel row 7A, 7B in a first unit 10A are offset such that an individual projection 5C in the first row 7A cover the space between two individual (neighbouring) projections 5A, 5B in the second row 7B when they are brought into contact with the textile surface to be cleaned during a sweeping motion, and bent away from their initial position, away from the direction of sweep.

The units 10A and 10B are mounted on the second face of the base section so as to define a passage 8 running from the outer (front) edge towards the centrally placed inlet 6 for airflow. The passage has a distal end facing the outer (front) edge and a proximal end facing the centrally placed inlet 6.

Similarly, the units 10C and 10D are mounted on the second face of the base section so as to define a passage 8 running from the outer (back) edge towards the centrally placed inlet 6 for airflow. The passage has a distal end facing the outer (back) edge and a proximal end facing the centrally placed inlet 6.

The central portion of the passage formed by the plurality of units 10A-B; 10C-D runs essentially parallel to the intended direction of sweep.

The width of the plurality of projections have different moments of resistance depending on the bending direction, so that when they are brought into contact with the textile surface to be cleaned, they are bent essentially in the lowest moment of resistance. Hence, when the suction nozzle is moved forward, the projections of units 10A and 10B are bent backward, while the projections of units 10C and 10D will be more resistant to bending; and when the suction nozzle is moved backward, the projections of units 10C and 10D are bent forward, while the projections of units 10A and 10B will be more resistant to bending.

Figure 2:
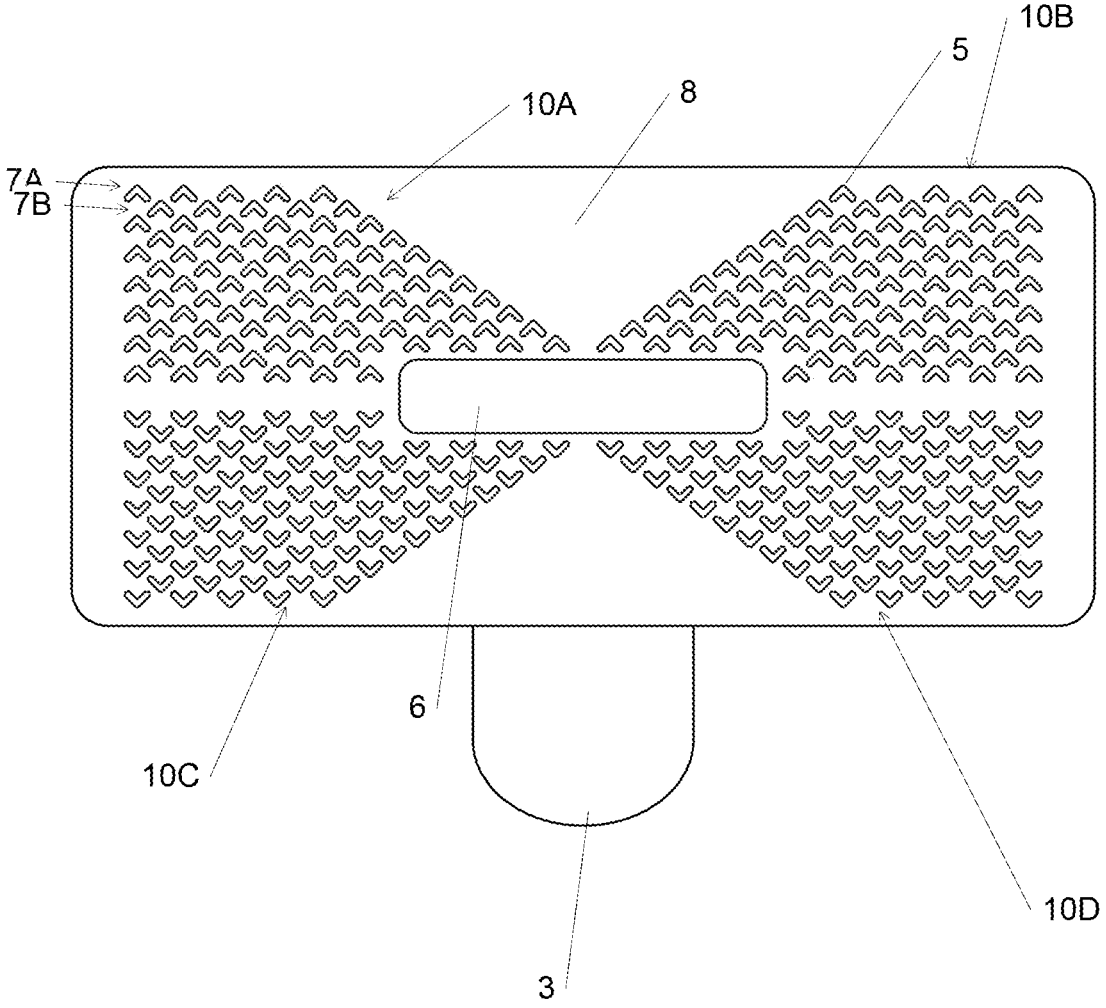
FIG. 2 shows a second suction nozzle of the present invention, viewed from the second face.

Referring to FIG. 2, a suction nozzle viewed from the second face is shown having only one inlet 6 for airflow. This embodiment allows the hair rolls to be directed through one passage at only two sides of the outer edge towards the one centrally placed inlet 6. The planar end faces of the projections are v-shaped; and a first and a second parallel row in a first unit are offset such that an individual projection in the first row covers the space between two individual (neighbouring) projections in the second row when they are brought into contact with the textile surface to be cleaned during a sweeping motion, and bent away from their initial position, away from the direction of sweep.

As also seen in FIG. 1, two units are mounted on the second face of the base section so as to define a passage 8 running from the outer (front) edge towards the centrally placed inlet 6 for airflow. The passage has a distal end facing the outer (front) edge and a proximal end facing the centrally placed inlet 6. Similarly, two units are mounted on the second face of the base section so as to define a passage 8 running from the outer (back) edge towards the centrally placed inlet 6 for airflow. The passage has a distal end facing the outer (back) edge and a proximal end facing the centrally placed inlet 6.

As also seen in FIG. 1, the projections are mounted in the individual units so that the widths of the plurality of projections have different moments of resistance depending on the bending direction. The two units facing the outer (front) edge have projections with the same moments of resistance at a given bending direction; and the two units facing the outer (back) edge have projections with the same moments of resistance at a given bending direction.

Figure 3:
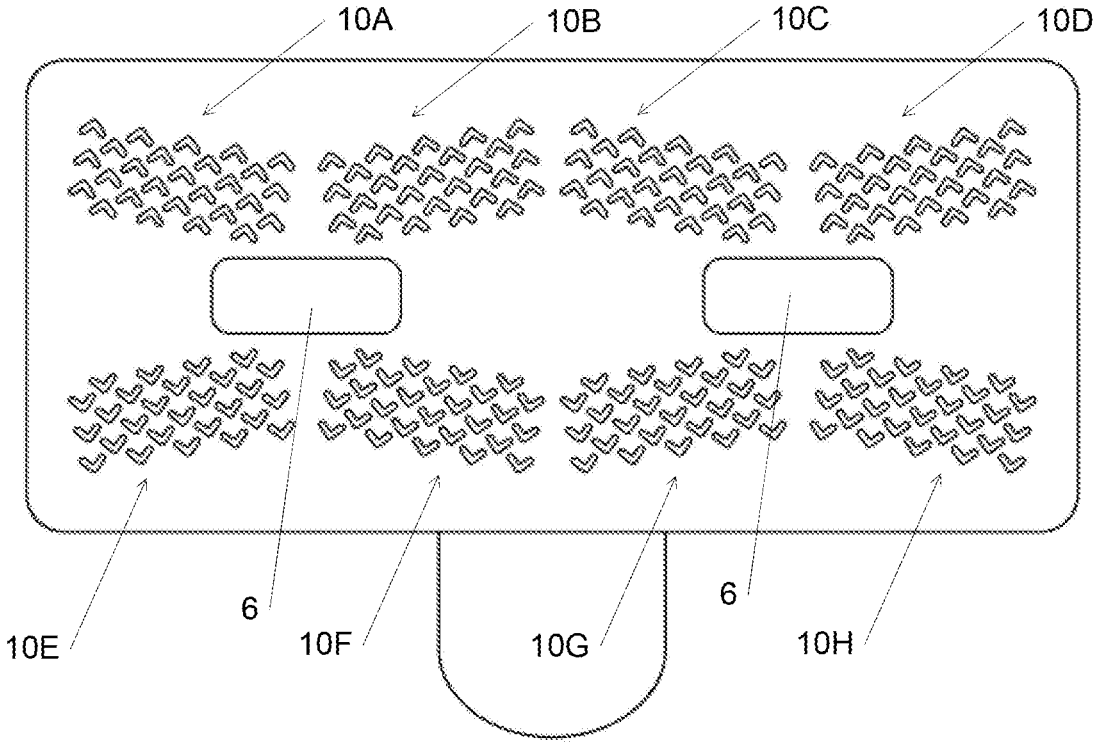
FIG. 3 shows a suction nozzle of the present invention with two inlets, viewed from the second face.
Figure 4:
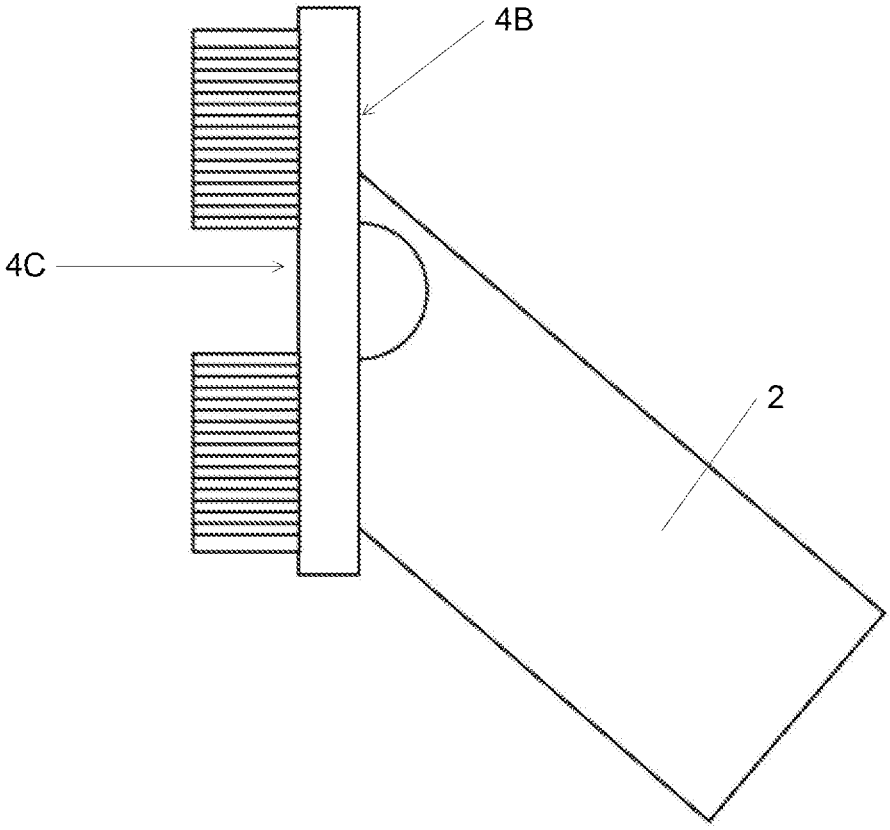
FIG. 4 shows a side view of suction nozzle of the present invention.

Referring to FIG. 3, a suction nozzle viewed from the second face is shown having two inlets 6 for airflow. This embodiment allows the hair rolls to be directed through two passages at the outer (front) edge and two passages at the outer (back) edge towards the two inlets 6. The planar end faces of the projections are v-shaped; and a first and a second parallel row in a first unit are offset such that an individual projection in the first row covers the space between two individual (neighbouring) projections in the second row when they are brought into contact with the textile surface to be cleaned during a sweeping motion, and bent away from their initial position, away from the direction of sweep.

The central portion of the passage formed by the plurality of units 10A-B; 10C-D; 10E-F; 10G-H runs essentially parallel to the intended direction of sweep.

Figure 5:
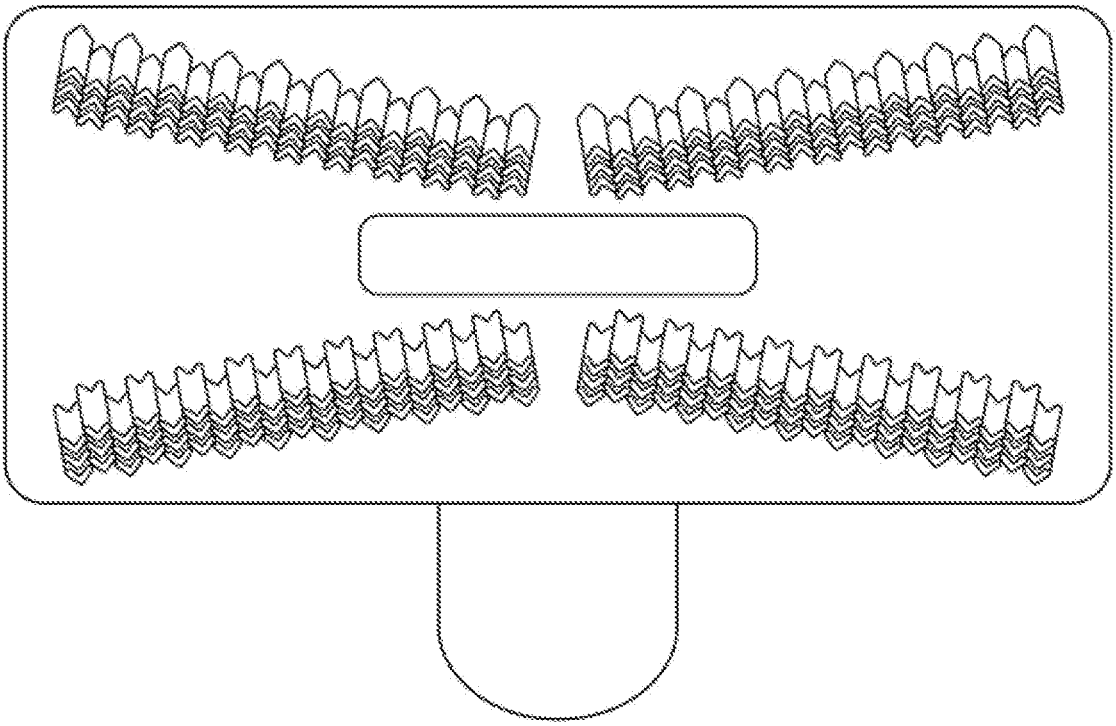
FIG. 5 shows a third suction nozzle of the present invention, viewed from the second face, and wherein the projections from one row are shown interacting with the projections from a neighbouring row.

Referring to FIG. 5, a suction nozzle as in FIG. 1 is shown. Here, it is shown how the projections from one row in an individual unit are interacting with the projections from a neighbouring row in the same unit, when they are brought into contact with the textile surface to be cleaned during a sweeping motion in the forward direction.

Figure 6A:
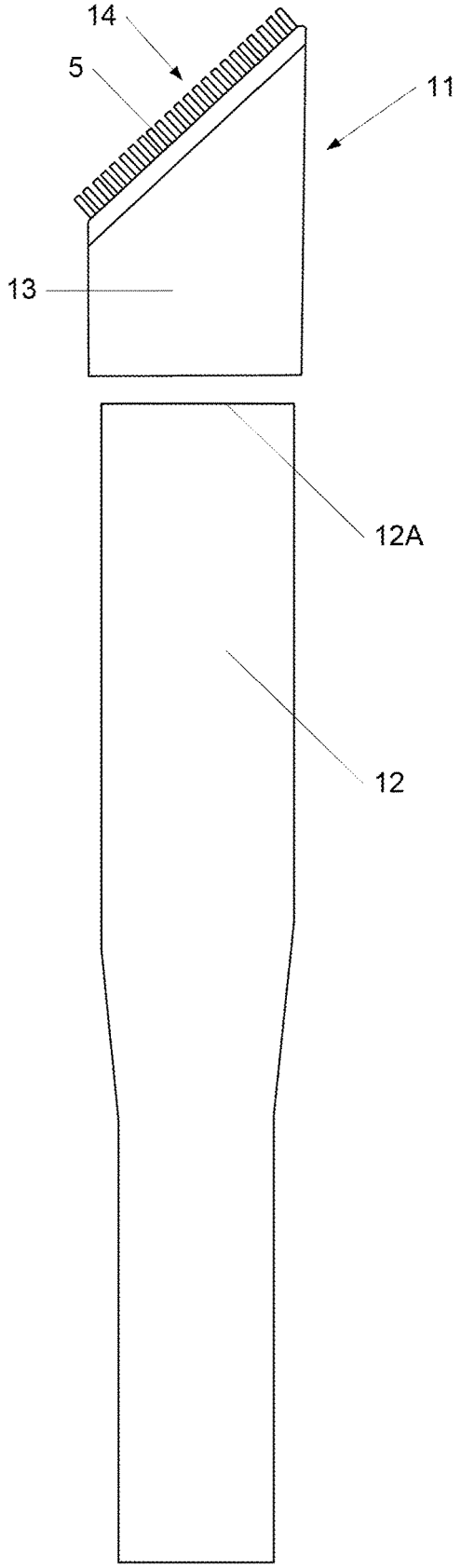
FIG. 6A shows a suction nozzle add-on of the present invention.
Figure 6B:
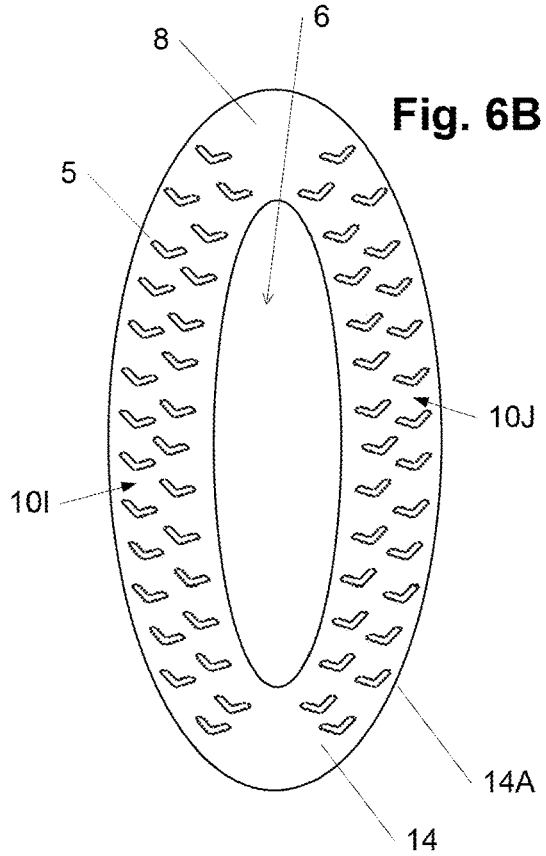
FIGS. 6B-C show two different embodiments of the suction nozzle add-on viewed from the front face.
Figure 6C:
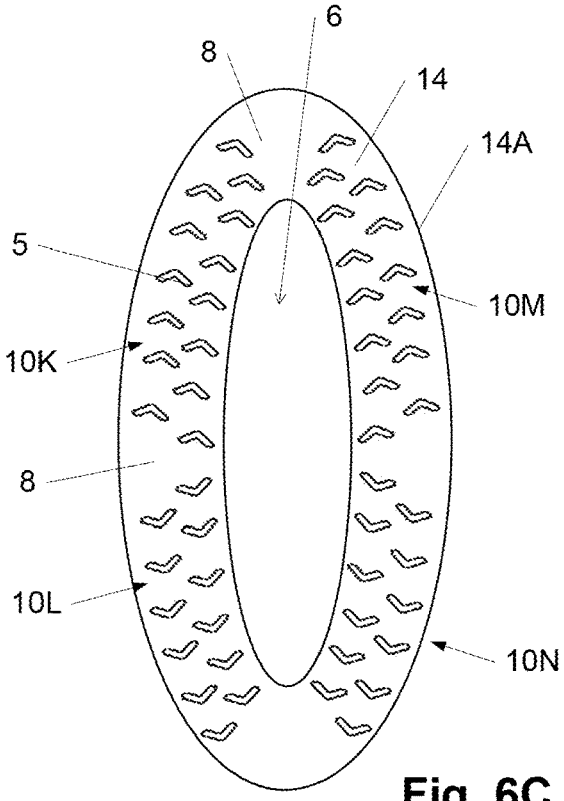

Referring to FIG. 6A, a suction nozzle add-on 11 is shown. The suction nozzle add-on 11 comprising a pipe socket 13 for connecting the suction nozzle add-on 11 to a pipe of a cleaning apparatus or to a front end of a suction nozzle 12 already attached to the cleaning apparatus. The pipe socket 13 comprises a front face 14 having an outer edge 14A. The front face 14 comprises a plurality of projections 5 and an inlet for airflow 6. The suction nozzle add-on 11 thus differs from the suction nozzle 1 shown in FIGS. 1-5 in that it the projections are positioned directly on the front face 14 of the pipe socket 13 and not on the base section 4. The suction nozzle add-on 11 can be used as an add-on to an existing sucking nozzle 12 attached to a cleaning device. The shape of the front face 14 resembles that of the front end of the suction nozzle 12 of the cleaning apparatus. The shape of the pipe socket 13 can be oval as shown in FIGS. 6B and 6C. The two different embodiments of the suction nozzle add-on viewed from the front face shown in FIGS. 6B-C differs in that the projections 5 are arranged in different units with units 10I and 10J in FIG. 6B and units 10K-N in FIG. 6C.

The front face 14 may have a shape resembling that of the pipe 12 of a cleaning apparatus or the suction nozzle 12 already attached to the cleaning apparatus. The pipe socket 13 and the plurality of projections 5 can be made from the same material, e.g a material having a Shore A-scale hardness measured according to ASTM D2240-97 within the range of 40-70. Choosing the same material for the entire suction nozzle add-on 11 allows the nozzle add-on to be made in the same process, e.g. by injection moulding.

The pipe socket 13 will normally be resilient bendable in the add-on version compared to the injection nozzle 1 of FIGS. 1-5, where the pipe socket 3 is rigid. The pipe socket 13 in the add-on 11 is therefore allowed to rebound to its initial shape when being removed from the pipe 12 of a cleaning apparatus or the suction nozzle 12 already attached to the cleaning apparatus.

REFERENCE LIST

1 suction nozzle
2 housing
3 pipe socket
4 base section
4A outer edge of the base section
4B first face of the base section
4C second face of the base section
5 projection
5A-C individual projection
6 inlet for air flow
7 parallel rows of projections
7A first parallel row of projections
7B second parallel row of projections
8 passage from the outer edge to the inlet
8A distal end of the passage
8B proximal end of the passage
10A-M unit of projections
11 suction nozzle add-on
12 suction nozzle of a cleaning apparatus
13 pipe socket
14 front face of the suction nozzle add-on
14A outer edge of the front face

The invention claimed is:

1. A suction nozzle add-on for cleaning apparatuses, for removing hair from a textile surface, the suction nozzle add-on comprising:

a pipe socket for connecting the suction nozzle add-on to a pipe of a cleaning apparatus or a suction nozzle already attached to the cleaning apparatus;

wherein the pipe socket comprises a front face comprising an outer edge, the front face comprising a plurality of projections and an inlet for airflow;

wherein the plurality of projections are resilient bendable, the plurality of projections are mounted on the front face so that when the plurality of projections are brought into contact with a textile surface to be cleaned during a sweeping motion, the plurality of projections are bent away from an initial position, away from a direction of the sweeping motion and, when the plurality of projections lose contact with the textile surface, the plurality of projections rebound to the initial position;

wherein the plurality of projections are aligned in a plurality of parallel rows, and wherein the plurality of parallel rows are mounted on the front face to define a passage running from the outer edge towards the inlet for airflow, the passage comprising a distal end facing the outer edge and a proximal end facing the inlet for airflow;

wherein at least an outer layer or coating of the plurality of projections is made from an elastomer for accumulating hair on the textile surface;

wherein a width of the proximal end of the passage is narrower than a width of the distal end, for guiding the accumulated hair at the tactile surface towards the inlet for airflow.

2. The suction nozzle add-on according to claim 1, wherein the front face has a shape resembling that of the pipe of the cleaning apparatus or the suction nozzle already attached to the cleaning apparatus.

3. The suction nozzle add-on according to claim 2, wherein the shape of the front face is oval.

4. The suction nozzle add-on according to claim 1, wherein the plurality of projections are made of a material having a Shore A-scale hardness measured according to ASTM D2240-97 within the range of 40-70.

5. The suction nozzle add-on according to claim 1, wherein the pipe socket and the plurality of projections are made from an identical material.

6. The suction nozzle add-on according to claim 1, wherein the pipe socket is made of a material having a Shore A-scale hardness measured according to ASTM D2240-97 within the range of 40-70.

7. The suction nozzle add-on according to claim 1, wherein the suction nozzle add-on is made by injection molding.

8. The suction nozzle add-on according to claim 1, wherein the pipe socket is resilient bendable when being connected to the pipe of the cleaning apparatus or a suction nozzle already attached to the cleaning apparatus, and wherein the pipe socket rebounds to an initial shape when being removed from the pipe of the cleaning apparatus or the suction nozzle already attached to the cleaning apparatus.

9. The suction nozzle add-on according to claim 1, wherein the plurality of parallel rows are mounted in one or more units, and wherein a first parallel row and a second parallel row of the plurality of parallel rows in a first unit of the one or more units are offset such that an individual projection in the first parallel row covers a space between two individual neighboring projections in the second parallel row when the individual projection in the first parallel row and the two individual neighboring projections are brought into contact with the textile surface to be cleaned during the sweeping motion, and bent away from the initial position, away from the direction of the sweeping motion.

10. The suction nozzle add-on according to claim 1, wherein the plurality of parallel rows are mounted in a plurality of units, wherein the plurality of units are mounted on a face of a base section to define the passage running from the outer edge towards the inlet for airflow, the passage having the distal end facing the outer edge and the proximal end facing the inlet for airflow;

wherein the width of the distal end of the passage is at least 1 cm, and wherein the width of the proximal end of the passage is narrower than the width of the distal end, for guiding the accumulated hair at the textile surface towards the inlet for airflow.

11. The suction nozzle add-on according to claim 1, wherein the plurality of projections are mounted on the front face so that a width of an individual one of the plurality of projections in one of the plurality of parallel rows is equal to or larger than a space between two individual neighboring projections of the plurality of projections in the one of the plurality of parallel rows.

12. The suction nozzle add-on according to claim 1, wherein a width of the plurality of projections is within the range of 2-30 mm, and a length of the plurality of projections is within the range of 5-50 mm.

13. The suction nozzle add-on according to claim 1, wherein a width of the plurality of projections have different moments of resistance depending on a bending direction.

14. The suction nozzle add-on according to claim 1, wherein the passage runs essentially parallel to an intended direction of sweep.

15. The suction nozzle add-on according to claim 1, wherein at least a central portion of the passage runs essentially parallel to an intended direction of sweep.

16. The suction nozzle add-on according to claim 1, wherein at least a free end face of each of the plurality of projections has a non-circular shape.

17. The suction nozzle add-on according to claim 1, wherein the pipe socket is adapted to connect to a vacuum cleaner or a suction nozzle already attached to the vacuum cleaner.

* * * * *